United States Patent [19]

Clem

[11] Patent Number: 4,467,015

[45] Date of Patent: Aug. 21, 1984

[54] WATERPROOFING STRUCTURE

[76] Inventor: Arthur G. Clem, 363 Cambridge Rd., Des Plaines, Ill. 60016

[21] Appl. No.: 317,059

[22] Filed: Nov. 2, 1981

[51] Int. Cl.[3] ..... B32B 19/00; B32B 29/04

[52] U.S. Cl. ..... 428/454; 52/169.14; 405/263; 428/906

[58] Field of Search ..... 52/169.14; 428/537, 428/454, 906; 405/263

[56] References Cited

U.S. PATENT DOCUMENTS

| | | | |
|---|---|---|---|
| 3,186,896 | 6/1965 | Clem | 428/454 X |
| 4,048,373 | 9/1977 | Clem | 428/454 |
| 4,103,499 | 8/1978 | Clem | 405/229 |
| 4,139,588 | 2/1979 | Clem | 524/447 X |
| 4,209,565 | 6/1980 | Davis et al. | 428/347 |
| 4,209,568 | 6/1980 | Clem | 428/454 |

*Primary Examiner*—Henry F. Epstein

*Attorney, Agent, or Firm*—Wallenstein, Wagner, Hattis, Strampel & Aubel

[57] ABSTRACT

The present invention relates to a waterproofing structure and method, and, in particular, to a flexible water-impervious sheet material, and to a method of using same, for providing an effective barrier against water seepage.

7 Claims, 3 Drawing Figures

WATERPROOFING STRUCTURE

TECHNICAL FIELD

The present invention relates to a waterproofing structure and method, and, in particular, to a flexible water-impervious sheet material, and to a method of using same, for providing an effective barrier against water seepage.

BACKGROUND OF THE PRIOR ART

In U.S. Pat. No. 4,209,568, a water-impervious panel is disclosed which comprises a water permeable support sheet such as a corrugated paperboard sheet on a surface of which is applied a gelled bentonite composition. The open-faced side of the panel is adapted to be pressed against a structure to secure the panel in place thereby providing a waterproof barrier.

In U.S. Pat. Nos. 3,186,896, 4,048,373, 4,103,499 and 4,139,588 moisture impervious panel constructions are disclosed, each of which employs a corrugated paperboard carrier for a water-swellable bentonite, or a sealant composition which incorporates a water-swellable bentonite as a principal component. The panels serve as water barriers for foundations and other in-ground installations.

While the panel constructions of the afore-mentioned patents function as seepage resistant structures, they have a number of shortcomings. Thus, for example, the use of a gelled bentonite composition as disclosed in U.S. Pat. No. 4,209,568 presents shipping and handling problems due to the generally paste-like character of the gel. The filled corrugated paperboard panels shown in the othr patents mentioned above utilize a relatively thin corrugated paperboard carrier which places undesirable restrictions on the amount of water-swellable material per unit area of the panel, a condition which can adversely affect the ability of the panels to provide adequate protection against seepage. In this same connection, the particle size of the water-swellable material loaded into the paperboard carrier must be carefully monitored to prevent, in the case where the particles are too coarse, the formation of voids, or, in the case where the material is too powdery, the formation of area of low density of the water-swellable material. A still further shortcoming of such filled corrugated paperboard panels is their rigid, comparatively inflexible construction, a property which essentially precludes bending the panels around corners, or conforming them to rounded or curved surfaces. This property of the panels also presents a problem when the margins of two, or more, adjacent panels are positioned in overlapping relation to each other.

The overlaps leave substantial air gaps which readily fill with water and act as pathways enabling water to reach the surface to be protected by the panels. The rigid, inflexible character of the panels also requires that they be cut, as by sawing, to enable them to be properly fitted on a surface to insure complete coverage. Sawing of the panels along, or transversely of, the water-swellable material containing flutes of the corrugated paperboard carrier results in the escape of a portion of the water-swellable material thereby leaving areas of the surface against which the sawed panels are positioned unprotected.

BRIEF SUMMARY OF THE INVENTION

In accordance with the present invention, water impervious structures are provided which overcome all of the shortcomings and disadvantages of water-proofing constructions such as those disclosed in the aforementiond U.S. patents. the flexible, pliable character of the structures of this invention make them uniquely adaptable for use in providing effective waterproofing and seepage resistance for subsurface installations such as foundations, as well as for pervious earth horizons to protect against seepage through dam faces, in-ground reservoirs, ponds, lagoons, fluid storage tanks, sanitary land fills, and the like. The structures can be cut to any desired size or configuration to enable them to conform to the contours of substantially any surface to which they are applied, or in which they are embedded. What is more, cutting of the structures in no way affects the integrity of the structures, or their waterproofing capabilities. The amount, and the physical properties of the active, that is, water adsorbing or absorbing agent or agents carried by the structures of the present invention can be selectively controlled and varied to meet the requirements of substantially any installation or area to be protected, and these requirements, once determined, will remain constant and uniform per each unit area of the structures. The flexibility of the structures, and the arrangement of the active agent or agents carried by them, furthermore, enable the margins of the structures to be overlapped with relation to the margins of adjacent structures without any concomitant formation of pathways, water courses, or passages through which water can penetrate or seep. The structures can be fabricated of inexpensive, readily available products, and can be conveniently shipped in the form of rolls to a point of use.

The water impervious structures, in brief, comprise a tiered or multiple layered arrangement wherein each successive layer or tier is formed of a flexible sheet material having a film or coating of a water swellable substance or composition on a surface thereof. The water swellable substance is characterized in that it will adsorb or absorb water in an amount sufficient to cause it to swell or expand to an extent necessary to fill available space, thereby to stop seepage of water and to seal off a surface to be protected, while at the same time not exerting any substantial pressure when confined against further swelling. The number of layers or tiers employed in forming the structures, and the nature of the water swellable coating, can be selectively varied to enable the structures to meet the performance demands of any surface or area to be protected against seepage. Irrespective of the number of tiers utilized to form the structures of this invention, the innermost, or surface contacting portion of the structures will comprise a coating of the water swellable substance, and the outermost portion, or the portion thereof through which water initially enters the structures, will comprise a flexible sheet material. The water swellable substance advantageously is maintained on a surface of each of the flexible carrier sheets by means of an adhesive, and each of the tiers comprising the structures are similarly maintained in stacked relation to one another. The structures may be supported on a surface to be protected by fastening means such as nails, or, in the case of subsurface, or in-ground, installations, by means of a mastic or tar, or simply by back-filling. The structures, as indicated, can be bent or flexed to make them conform to a surface of substantially any configuration, and can be cut to any desired shape and dimensions to assure complete coverage of a surface. They can be shipped, stored and used in roll form in sizes which can be easily handled by a single workman. The structures can be manufactured in a continuous process with standard equipment utilizing readily available, inexpensive materials.

The foregoing, and other advantages and features of the invention will become more apparent from the description to follow, taken in conjunction with the accompanying drawings wherein:

DETAILED DESCRIPTION OF THE INVENTION

Figure 1:
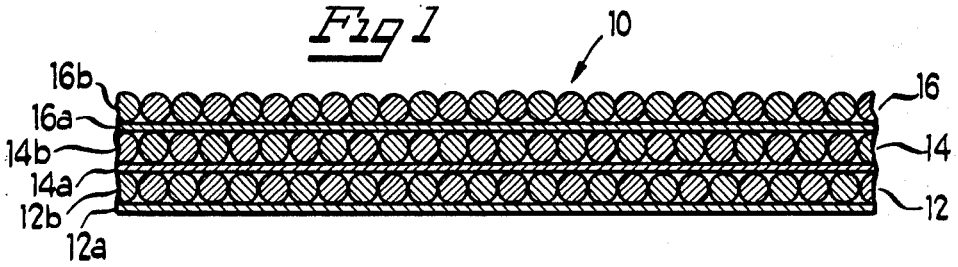
FIG. 1 is a somewhat schematic illustration of an embodiment of the invention wherein the structure comprises three tiers or layers.

The embodiment of the structure illustrated in FIG. 1, and designated generally by reference numeral 10, includes three layers or tiers 12, 14 and 16, each tier, in turn, comprising a flexible, water permeable carrier sheet 12*a*, 14*a* and 16*a* having a film or coating 12*b*, 14*b* and 16*b*, respectively, of a water swellable substance or composition on a surface thereof. While the structure 10 is shown as comprised of three layers or tiers, it should be understood that the present invention contemplates structures having at least two layers or tiers, and upwards of four, five, or more, tiers, depending upon the weight and thickness of the active material, that is, the water swellable substance or composition required per square foot of the structure to protect or insulate a surface or area against damage due to seepage. Irrespective of the number of tiers employed to form the structures, a coating of the active material will be positioned in contact with, or will face in the direction of, the surface or area to be protected.

The flexible carrier sheets of the structures may all be formed of the same sheet material, or they may be formed of different sheet materials. Thus, for example, each of the carrier sheets 12*a*, 14*a* and 16*a* of the structure 10 may be fabricated of paper, including sulfite and sulfate papers, Kraft papers, groundwood papers, filter papers, and the like; paperboard; woven or non-woven natural and synthetic fabrics; fiberglass; or the like water permeable sheet material, or the innermost sheets 14*a* and 16*a* may be formed of water permeable paper, while the outermost sheet 12*a* may be formed of water permeable fiberglass, for example, to provide added strength, and resistance to tearing or rupture during installation of the structure 10. The thickness of the carrier sheet materials used in fabricating the structures of this invention may range from about 1 mil to about 10 or 12 mils, usually from about 5 to about 8 mils.

The water swellable substance or composition used to form the multiple layered or tiered structures of this invention is characterized in that it is capable of adsorbing or absorbing water in an amount which is several times greater than the original weight of the substance or composition, and, in addition, is capable of retaining the water even when subjected to high pressures. The substance or composition is further characterized in that it will swell only to the extent necessary to fill available space without exerting any substantial pressure when physically restricted or confined against further swelling, and will form a permanent, viscous, high strength gel which is water impervious and serves as an effective seepage resistant barrier.

Exemplary of water swellable substances and compositions useful in fabricating the structures of the present invention are those disclosed in the aforementioned U.S. patents. Thus, for example, the water swellable substance may be a bentonitic or colloidal clay of the type disclosed in U.S. Pat. No. 3,186,896. Typical water swellable compositions useful for the purposes of this invention are the dry granular compositions disclosed in U.S. Pat. No. 4,103,499 and No. 4,139,588. The compositions comprise a major proportion of bentonite, and minor proportions of a water soluble polymer such as polyacrylic acid, and a water soluble acid salt such as alkali metal phosphates, acetates and borates.

A preferred water swellable substance for use in forming the structures of this invention is a bentonite obtained from regions in Wyoming and South Dakota, especially hydratable metal salts thereof. Specific examples of such hydratable bentonite salts are sodium bentonite, lithium bentonite, potassium bentonite, magnesium bentonite, calcium bentonite, barium bentonite and strontium bentonite, to mention a few. Of this group, sodium bentonite is the preferred metal salt. Bentonites of this type can absorb almost five times their weight of water, and will swell as much as twenty times their dry volume. They form high viscosity and high strength gels which provide excellent resistance to seepage.

The size of the granules or particles of the water swellable substance or composition employed to form the structures is somewhat variable. In those instances where sodium bentonite is used, the generally optimum objectives of the invention are attained with particles ranging in size from about 20 or 30 mesh upwards to about 3/16 to about 5/16 inch, preferably about $\frac{1}{8}$ to about $\frac{1}{4}$ inch. The size of the granules or particles comprising each of the films or coatings of the water swellable substance may all be substantially uniform, or the size of the particles used to form one film or coating may differ from the size of the particles used to form the other coating or coatings comprising a structure. Thus, by way of illustration, in the structure 10 illustrated in FIG. 1, the coatings 12*b* and 14*b* may be formed of $\frac{1}{4}$ inch particles while the innermost coating 16*b* may be formed of $\frac{1}{8}$ inch particles to provide greater contact between the water swellable particles and a surface to be protected against seepage. By proper selection of the size of the particles employed in forming the films or coatings of the water swellable substance or composition, and the number of layers or tiers comprising the structure, the thickness and weight of water swellable substance or composition per unit area of a structure can be selectively predetermined to provide a structure capable of meeting the performance demands of substantially any surface or area to be protected against damage due to seepage. Generally speaking, the total thickness of the coatings of water swellable substance or composition employed in the structures of the present invention may range from about 1/16 inch to about 1 inch, usually from about $\frac{1}{4}$ inch to about $\frac{3}{4}$ inch.

The granules or particles of the water swellable substance or composition advantageously are secured to the flexible carrier sheets comprising the structures by means of an adhesive which desirably is applied to a surface of the carrier sheet just prior to forming a film or coating of the particles on the sheet. The type of adhesive used may be any of various inexpensive, readily available, water soluble or insoluble, or solvent soluble or insoluble, materials. Exemplary of suitable adhesives are wheat starch, corn starch, carboxymethyl cellulose, dextrin, animal glue, rubber cement, shellac, latex emulsions, sugar modified sodium silicate, or the like. Only a thin film of the adhesive is needed to maintain the particles on the carrier sheet. The adhesive may be applied with conventional equipment as by doctor blade, spraying, roller coating, extrusion, or the like, technique.

Figure 2:
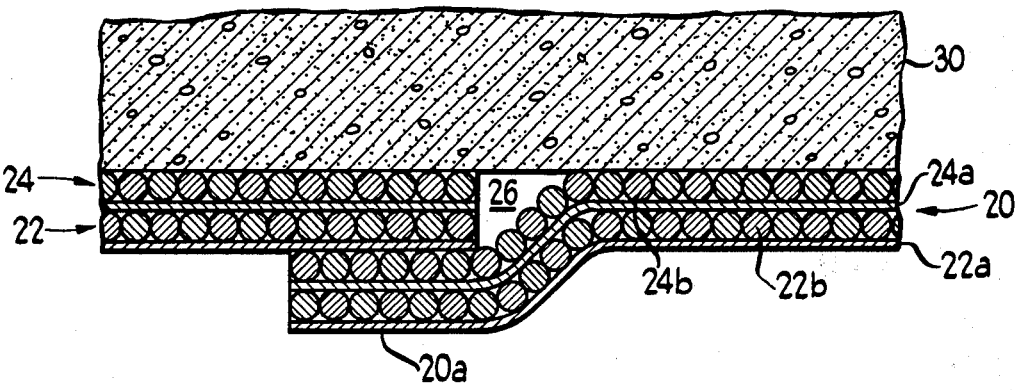
FIG. 2 is a somewhat schematic illustration of another embodiment of the invention installed on a surface to be protected.
Figure 3:
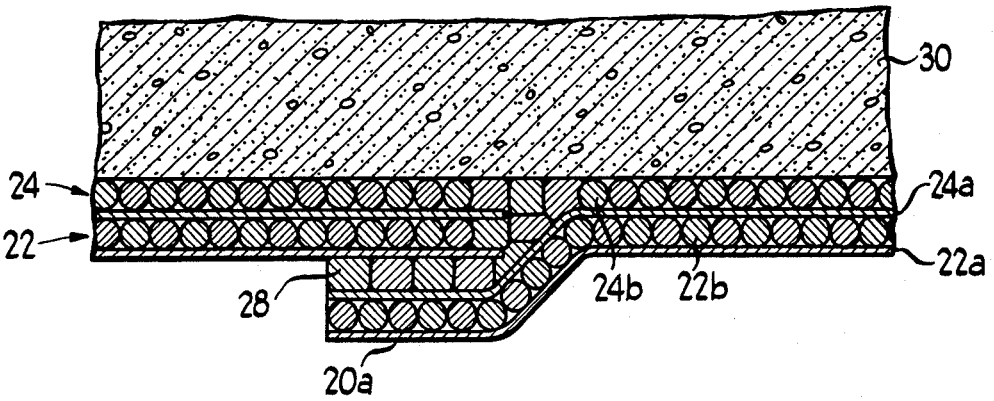
FIG. 3 is a view corresponding to the view of FIG. 2 showing the establishment of a water impervious seal at the overlapped margins of the two sections of the structure.

Referring, now, to FIGS. 2 and 3 of the drawing, two sections of another embodiment of the structure, designated generally by reference numeral 20, of this invention are shown installed against an in-ground concrete wall 30 with their adjacent side or end margins 20*a* positioned in overlapping relation to one another. The sections of the structure 20 each comprise two layers or tiers 22 and 24, each tier, in turn, including a flexible, water permeable carrier sheet 22*a* and 24*a* having a film or coating 22*b* and 24*b*, respectively, of a water swellable substance or composition adhered on a surface thereof. The sections of the structure 20 are installed in a manner to position the exposed film or coating 24*b* of the water swellable substance or composition against the outer surface of the wall 30. The sections may be attached to the wall 30, and secured to each other, by means of a mastic, or tar, or, if desired, by metal fasteners such as nails.

After the installation has been backfilled, water passing through the carrier sheets 22*a* and 24*a*, and water coming into contact with the coatings 22*b* and 24*b* at the overlapped margins 20*a* of the sections of the structure 20, will cause the granules or particles of the water swellable substance or composition to swell and fill any space, such as the space 26 (see FIG. 2), which may have been formed by placing the margins or ends of the two sections of the structure in overlapping relation. The swelling of the particles will continue until the space 26 is closed to provide a water impermeable seal 28 (see FIG. 3) at the juncture of the two sections of the structure. Similarly, the particles comprising the coatings 22*b* and 24*b* away from the overlapped margins or ends of the sections of the structure 20 will swell and form a highly viscous, high strength gel which will provide a permanent, effective barrier against seepage. The backfill, not shown, acts to restrain further swelling of the water swellable substance or composition comprising the coatings 22*b* and 24*b*. This restraint enables the water swellable substance or composition to swell only to the extent necessary to fill any spaces where seepage may occur without exerting any substantial pressure against the concrete wall 30. After the coatings have formed a permanent, waterproof barrier, the carrier sheets 22*a* and 24*a* may degrade biochemically, or otherwise disintegrate, without adversely affecting the integrity of the waterproof barrier formed by the water swelled coatings 22*b* and 24*b*.

While for purposes of illustration, specific embodiments of the present invention have been disclosed, other embodiments thereof may become apparent to those skilled in the art and, accordingly, the invention is to be judged on the basis of the appended claims.

I claim:

1. A water impermeable structure for protecting a surface or area against damage due to water seepage, comprising: at least two layers positioned in stacked, superposed relation to one another and capable of being formed into a roll, each layer including a sheet of a water permeable material and a continuous coating of dry particles, of a preselected size, of bentonite on one surface of said sheet, said particles of bentonite being adhered to said one surface of the sheet by a film of an adhesive, each layer of the structure being adhered in fixed relation to a contiguous layer by means of an adhesive applied between the uncoated surface of a sheet of a water impermeable material comprising one layer of the structure and the continuous coating of dry particles of bentonite of said contiguous layer of the structure, at least one continuous coating of dry particles of bentonite comprising a layer of the stack structure being exposed, the layers of the structure being arranged in fixed relation to one another such that the said at least one exposed continuous coating of dry particles of bentonite will be in contact with or face in the direction of a surface or area to be protected against damage due to water seepage, said dry particles of bentonite being characterized in that they form a water impermeable barrier upon contact with water.

2. A structure according to claim 1 wherein the sheet material is paper.

3. A structure according to claim 1 wherein the sheet of water permeable material comprising each layer is formed of a biodegradable material.

4. A structure according to claim 1 wherein the coating of bentonite on each sheet of water permeable material comprises granules or particles ranging in size from about 20 mesh to about 5/16 inch.

5. A structure according to claim 1 wherein the size of the granules or particles comprising the exposed coating of bentonite differ from the size of the granules or particles comprising the other coating or coatings of bentonite.

6. A structure according to claim 5 wherein the granules or particles comprising the exposed coating of bentonite which will be in contact with or face in the direction of the surface or area to be protected against seepage are smaller in size than the granules or particles of the other coating or coatings of bentonite of the structure.

7. A structure according to claim 1 wherein the coatings of bentonite comprise a major proportion of sodium bentonite.

* * * * *